United States Patent [19]

Lamberti et al.

[11] 3,966,647

[45] June 29, 1976

[54] PERFUME COMPOSITIONS CONTAINING MONOALKYL-PARA-DIOXANES

[75] Inventors: Vincent Lamberti, Upper Saddle River; Eddie N. Gutierrez, Fort Lee, both of N.J.

[73] Assignee: Lever Brothers Company, New York, N.Y.

[22] Filed: Apr. 8, 1975

[21] Appl. No.: 566,580

Related U.S. Application Data

[62] Division of Ser. No. 452,222, March 18, 1974, abandoned.

[52] U.S. Cl. ..... 252/522; 260/340.6

[51] Int. Cl.[2] ..... C11B 7/00

[58] Field of Search ..... 252/522; 260/340.6, 260/340.7

[56] References Cited

UNITED STATES PATENTS

| | | | |
|---|---|---|---|
| 2,743,280 | 4/1956 | Feasley et al. | 260/340.6 |
| 2,743,281 | 4/1956 | Feasley et al. | 260/340.6 |
| 2,769,014 | 10/1956 | Beets | 252/522 |
| 3,326,746 | 6/1967 | Cahn et al. | 252/522 |
| 3,423,430 | 1/1969 | Cahn et al. | 252/340.7 |
| 3,884,841 | 5/1975 | Maesseu et al. | 252/522 |

FOREIGN PATENTS OR APPLICATIONS

| | | | |
|---|---|---|---|
| 981,285 | 1/1965 | United Kingdom | 252/522 |

OTHER PUBLICATIONS

Elad et al., J. Org. Chem. 29 (7) 2031–2032, 1964.

Iovchev et al., Monatshefte fur Chemie, 99 (2) pp. 545–548, 1968.

Iovchev et al., Monatshefte fur Chemie, 102, (1) pp. 114–117, 1971.

Summerbell et al., J. Amer. Chem. Soc., 61, pp. 3016–3019, 1939.

Wallace et al., *Nature*, 198, pp. 284–285, 1963.

*Primary Examiner*—Veronica O'Keefe

*Attorney, Agent, or Firm*—Kenneth F. Dusyn; James J. Farrell; Arnold Grant

[57] ABSTRACT

Novel monoalkyl-para-dioxanes wherein the alkyl group has 5, 7 or 9–22 carbon atoms, and known monoalkyl-para-dioxanes wherein the alkyl group has 4, 6 or 8 carbon atoms are useful in perfumery, specific members finding utility as components to modify the odor of a perfume blend, or as fixatives.

5 Claims, No Drawings

PERFUME COMPOSITIONS CONTAINING MONOALKYL-PARA-DIOXANES

This is a division of application Ser. No. 452,222, filed Mar. 18, 1974, now abandoned.

BACKGROUND OF THE INVENTION

1. Field of the Invention

The present invention relates to monoalkyl-para-dioxanes having alkyl groups of about 4 to about 22 carbon atoms.

These compounds find utility in the perfume art, either for their contribution to odor or for their fixative properties.

2. The Prior Art

Certain monoalkyl-, dialkyl-, and alkenyl-para-dioxanes wherein the side substituents are of low molecular weight are known to the art, although none has been recognized in the art as having utility in perfumery. Examples of the published literature on the subject are the articles listed below.

Castro, Bertrand, Bull. Soc. Chim., Vol. 57, 1547–51 (1967) (In French). This article discloses the methyl, n-hexyl-vinyl, propenyl, dimethyl, diethyl, and methyl ethyl-para-dioxanes.

Normant, H., and Castro, Bertrand, Compt. Rendu, Vol. 25, (4), 830–2, (July 27, 1964) (In French). Discloses n-propyl, n-hexyl, vinyl, propenyl, dimethyl, diethyl and methyl ethyl-para-dioxanes.

Wallace, et al., Nature, 284–5 (Apr. 20, 1963). Interprets the reaction of para-dioxane with 1-octene and tert-butyl peroxide as a free-radical reaction.

Elad, D., and Youssefyeh, J. Org. Chem., Vol. 29 (7), 2031–2 (1964). Discloses n-octyl-para-dioxane.

Summerbell, R., and Umhoefer, R., J. Amer. Chem. Soc., Vol. 61, 3016–19 (1939). Discloses methyl, ethyl, n-propyl, n-butyl and alkyl-para-dioxanes.

SUMMARY OF THE INVENTION

It has now been discovered that monoalkyl-para-dioxanes having about 4 to about 22 carbon atoms in the alkyl group have useful properties not heretofore known or recognized.

Contrary to opinions regarding the odor of the above-named compounds expressed in the published art, certain monoalkyl-para-dioxanes have useful odors suitable as perfume materials. Some have odors reminiscent of rose-type perfumes and are useful to provide important notes to the floral fragrances.

The higher members of the series find utility as perfume fixatives.

DETAILED DESCRIPTION OF THE INVENTION

The present invention as a first embodiment relates to novel compositions which are monoalkyl-para-dioxanes having the structure:

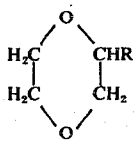

wherein R is a straight-chain hydrocarbon radical selected from the group consisting of pentyl, heptyl, nonyl, decyl, hendecyl, dodecyl, tridecyl, tetradecyl, pentadecyl, hexadecyl, heptadecyl, octadecyl, nonadecyl, cicosyl, heneicosyl, and docosyl radicals, and mixtures thereof.

As a second embodiment, the invention relates to detergent, shampoo and bleach compositions having as a perfume component therein a compound of the foregoing molecular structure wherein R is a straight-chain hydrocarbon radical having about 4 to about 22 carbon atoms, and mixtures thereof.

As a third embodiment, the invention relates to perfume blends wherein one or more of the above-named n-alkyl-para-dioxanes is present as a component to function as a fixative, as an extender, or to impart a modified note to the blend.

Accordingly it is an object of the present invention to provide novel monoalkyl-para-dioxanes having utility in perfumery.

It is another object of the invention to provide detergent, shampoo, and bleaching compositions having therein a mono-alkyl-para-dioxane as a perfume component.

The monoalkyl-para-dioxanes wherein the alkyl group has about 4 to about 12 carbon atoms have interesting odors of the herbaceous or rose type and are useful in floral blends.

The fragrant members of the series, i.e., those having about 4 to about 12 carbon atoms in the alkyl substituent, are especially compatible with phenylethyl alcohol, and are valuable as extenders for the more expensive geranium oil. n-Butyl-para-dioxane is suitable as an extender for lavender and lavender-type oils, such as lavendin oil and is useful in fern and chypre-type perfumes.

The compound n-hexyl-para-dioxane is useful as an extender for geranium and the like oils, and n-dodecyl-para-dioxane is useful in rose and lily-of-the-valley type perfumes.

Members of the series having about 14 to about 22 carbon atoms in the alkyl substituent are useful as perfume fixatives.

By the term "extender" as used herein is meant a compound having an odor, and which is compatible both as to solubility and odor, with a more expensive or less available perfume oil, and when admixed or used in conjunction therewith, extends the usefulness of the oil.

Descriptions of perfume oils useful in the practice of the present invention may be found in "The Essential Oils", E. Guenther, Vols. I–VI, 1948–1952, D. Van Nostrand Co., Inc., New York.

The monoalkyl-para-dioxanes may be prepared in accordance with the reaction:

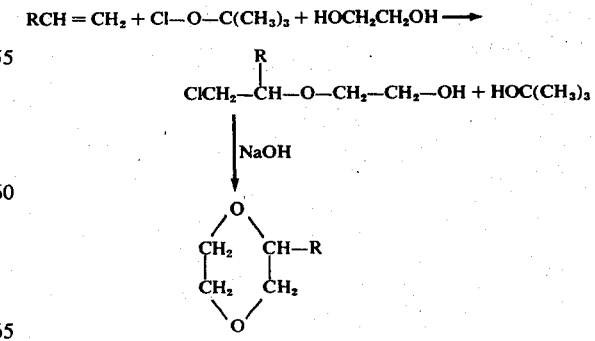

wherein R is a straight-chain hydrocarbon radical having about 4 to about 22 carbon atoms. More specifically, R may be butyl, pentyl, hexyl, heptyl, nonyl, decyl, hendecyl, dodecyl, tridecyl, tetradecyl, pentadecyl, hexadecyl, hetpadecyl, octadecyl, nonadecyl, eicosyl, heneicosyl, and docosyl radicals.

The method for preparing the compounds will be described as a two-part method. The procedure suitable for the $C_4$–$C_{14}$ alkyl-para-dioxanes is modified for the $C_{16}$–$C_{22}$ compounds.

As the first part of the preparation of the para-dioxanes having $C_4$–$C_{14}$ alkyl groups, 0.4 mole of a 1-alkene of desired chain length is placed in a 250-ml, 3-neck flask along with 200 ml of ethylene glycol. A quantity of 0.4 mole of t-butyl hypochlorite is then added while stirring the reaction mixture, maintaining the temperature at 25° to 45°C. Upon completion of the reaction, the reaction product is extracted with ethyl ether, and the ethereal extract is washed with water. The washings are discarded and the washed ether extract is subjected to the action of a roto-evaporator to concentrate the ether solution by removing substantially all of the ether.

The second, or cyclization, part is conducted as follows:

Into a flask is placed 0.03 mole of the reaction product obtained from the ethereal extract in the above-described first part, and next there are added 0.14 mole NaOH in 10 ml of water. The mixture is refluxed for 2 hours. The progress of the reaction is followed by GLC (Gas-Liquid Chromatographic) analysis. The product is extracted with ethyl ether, the ether layer is washed with water to remove NaOH, and the washed ether extract is concentrated by removing substantially all of the ether in a roto-evaporator. The desired product is then isolated.

The isolation procedure in the above-described method may vary, depending upon the molecular weight of the compound. The isolation procedures for typical members of the series are shown in the following table.

TABLE I

VARIATIONS IN THE ISOLATION PROCEDURE

| R | Summary of the Procedure |
|---|---|
| $C_4H_9$ | Distill product from ether residue. |
| $C_6H_{13}$ | Cool ether residue to −70°C and filter to separate solids. Solids are recrystallized from acetone. Solids melt at room temperature. |
| $C_{10}H_{21}$ | Cool ether residue at 0°C. Product crystallizes. Filter, wash with water, and dry. |
| $C_{14}H_{29}$ | Product crystallizes out of ethereal residue. Filter, wash with water and dry. |

The higher members of the series, wherein R is $C_{16}H_{33}$ to $C_{22}H_{45}$ inclusive, may be prepared by the following procedure, illustrated in terms of the octadecyl derivative.

For the first part of the preparation, 0.3 mole of 1-eicosene and 300 ml of ethylene glycol are placed in a 250 ml, 3-neck flask and 0.35 mole of t-butyl hypochlorite, with stirring. The solution is then heated to 55°C for 3 hours with continued stirring, after which the solution is cooled to about room temperature and the solids which form upon cooling are collected on a filter.

To carry out the second part, 60 grams of the solids from the first part are dissolved in 200 grams of dimethoxyethane containing 10 gram of NaOH. The solution is then refluxed for 7 hours. The contents of the flask are cooled, and the resulting solids are separated from the liquid portion by filtration. The solids, which are composed almost entirely of n-octadecyl-para-dioxane, are washed with water to remove any base present, and dried.

The physical forms of typical members of the series are presented below in Table II.

TABLE II

PHYSICAL FORMS OF TYPICAL MEMBERS OF THE MONOALKYL-PARA-DIOXANE SERIES

| R (alkyl) | Physical Form (Room Temperature) | Melting Point, °C | Boiling Point, °C |
|---|---|---|---|
| $C_4H_9$ | Liquid | — | 175° at 763 mm |
| $C_6H_{13}$ | " | — | 230° 232° at 756 mm |
| $C_{10}H_{21}$ | Solid | 41° | — |
| $C_{14}H_{29}$ | " | 49° | — |
| $C_{18}H_{37}$ | " | 50.2° | — |

The monoalkyl-para-dioxanes having about 4 to about 22 carbon atoms in the alkyl substituent find particular utility in detergent compositions. The dioxanes may if desired be employed as the sole perfume ingredient, but normally will be used as a component of a blend of perfume oils to impart a desirable modification to the blend. The dioxanes are stable toward all of the substances customarily employed in detergent compositions, including alkalis and oxidants.

The detergent compositions wherein the monoalkyl-para-dioxanes are useful may comprise any surfactant species, whether anionic, cationic, nonionic, or amphoteric, including the soaps. All of the usual builder substances may be employed, such as the polyphosphates, orthophosphates, carbonates, citrates, oxydiacetates, oxydisuccinates, carboxymethyloxysuccinates, etc. Oxidizing agents, such as the perborates, hypochlorites, dichlorocyanurates, etc. have no effect or the odor of the monoalkyl-para-dioxanes wnen employed together in detergent or dry bleach compositions.

When employed in admixture as an extender for a single perfume oil, the proportion of n-alkyl-para-dioxane may range from about 1% to about 99%, on the mixture basis. A preferred range is about 10% to about 90%, and most generally a mixture of an n-alkyl-para-dioxane as an extender for a single oil will contain about 20% to about 75% of the extender by weight.

When a perfume blend containing one or more n-alkyl-para-dioxanes in the useful proportions set forth herein is employed in a detergent or soap composition, the proportion of n-alkyl-para-dioxane in the total composition will usually vary from about 0.001% to about 2%, by weight.

The selection of any particular component or proportion thereof of a detergent or soap composition wherein a monoalkyl-para-dioxane is to be incorporated will depend upon the detergency effect desired, and forms no part of the present invention.

Suitable detergent or soap compositions may be in any of the usual forms, particulate, liquid, bar, or briquette. Shampoo compositions are suitable, and may be based on soaps or nonsoap detergents.

Suitable soap and nonsoap detergent species, builders to enhance detergency, and miscellaneous adjuvants are discussed in the texts, "Surface Active Agents" by Schwartz and Perry, and "Surface Active Agents and Detergents" by Schwartz, Perry and Berch, both Interscience Publishers, New York, N.Y., the disclosures of both being incorporated herein by reference.

Suitable particulate detergent compositions are disclosed in U.S. Pat. Nos. 2,829,102, 2,829,108 and 3,188,291, particulate soap compositions in U.S. Pat. Nos. 2,329,694 and 2,940,935, detergent tablets in U.S. Pat. Nos. 3,055,837, 3,043,779 and 2,894,912, soap tablets in U.S. Pat. Nos. 2,404,298, 2,649,417, 2,215,539 539 and 3,284,363, liquid detergent compositions in U.S. Pat. Nos. 2,941,950 and 3,052,635 and shampoos in U.S. Pat. Nos. 3,086,943 and 3,263,733, all of which are incorporated herein by reference.

The invention will be more clearly understood by reference to the following examples, which are to be considered to be illustrative, but not limitative, of the invention.

EXAMPLE 1

Monoalkyl-para-dioxanes wherein the alkyl substituent is n-butyl, n-hexyl, n-decyl, n-tetradecyl and n-octadecyl are prepared by the procedures described hereinabove, and the odors thereof evaluated. The odors of the compounds thus prepared are set forth below.

| Alkyl | Odor |
|---|---|
| $C_4H_9$ | Coumaric odor similar to dimethyl hydroquinone. Also a rosy, tonkat odor. |
| $C_6H_{13}$ | Lavender odor with slight rosy note. |
| $C_{10}H_{21}$ | Rosy note reminiscent of benzophenone. Also a soapy rose note (fatty alcohol type). |
| $C_{14}H_{29}$ | Etheral, slightly rosy, note similar to that of octadecalacetone. |
| $C_{18}H_{37}$ | Similar to above wherein $R = C_{14}H_{29}$ |

EXAMPLE 2

The products of the present invention find utility in the following perfume blends.

TABLE II

| Component | Percent By Weight A | B | C | D | E | F | G | H |
|---|---|---|---|---|---|---|---|---|
| Citronella | 23 | 2 | | | | 25 | 35 | 35 |
| Verbena | 1 | | | | 10 | | | |
| Lavender | 30 | | 10 | | 5 | | | |
| Caraway | 3 | | | 1 | | | | |
| Cassia | 5 | | | 10 | | | | |
| Ylang-ylang | | 2 | | 9 | | | | |
| Cananga | | 3 | | 10 | | | | |
| Coumarin | | 4 | 5 | | 5 | | | |
| Geranium | | 5 | | | | 10 | | |
| Terpineol | | 74 | 10 | 35 | 5 | 10 | 10 | |
| Phenylethyl alcohol | 12 | | 30 | | 20 | | | |
| Alpha-ionone | | | 10 | | 5 | | | |
| Thyme | | | | 3 | | | | |
| Benzyl acetate | 21 | | 15 | 10 | 20 | 25 | 25 | 30 |
| Genaniol | | | 10 | 12 | 20 | 10 | | |
| n-Butyl-para-dioxane | | 10 | | | | | | |
| n-Pentyl-para-dioxane | | | 5 | 5 | | | | |
| n-Hexyl-para-dioxane | 5 | | | | | | | |
| n-Heptyl-para-dioxane | | | | 5 | | | | |
| n-Octyl-para-dioxane | | | | | 10 | | | |
| n-Decyl-para-dioxane | | | 5 | | | | | |
| n-Dodecyl-para-dioxane | | | | | | 20 | | |
| n-Tetradecyl-para-dioxane | | | | | | | 30 | |
| n-Hexadecyl-para-dioxane | | | | | | | | 35 |
| | 100 | 100 | 100 | 100 | 100 | 100 | 100 | 100 |

EXAMPLE 3

A mixture having a rose-like odor suitable for use alone or in a perfume blend is prepared by combining together about 75% to about 99% by weight of phenylethyl alcohol, and as the balance, about 25% to about 1% by weight of a compound selected from the group consisting of n-octyl-para-dioxane, and n-dodecyl-para-dioxane, and mixtures thereof.

EXAMPLE 4

A mixture having a geranium fragrance suitable for use alone or in a perfume blend is prepared by combining together about 50% to about 99% by weight of geranium oil, and as the balance, about 50% to about 1% by weight of n-hexyl-para-dioxane. The geranium oil may be any of the known natural geranium oils or may be a synthetic blend.

EXAMPLE 5

A mixture having a lavender fragrance suitable for use alone or in a perfume blend is prepared by combining together about 75% to about 99% by weight of lavender oil, and as the balance, about 25% to about 1% by weight of n-butyl-para-dioxane.

EXAMPLE 6

A mixture with a fragrance for imparting a floral odor note to a perfume blend suitable for use in a detergent composition comprises about 10 to about 90% by weight of phenylethyl alcohol or geranium oil, the balance being a monoalkyl-para-dioxane compound having the formula:

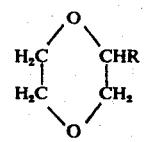

wherein R is a straight chain hydrocarbon group having about 4 to about 22 carbon atoms.

EXAMPLE 7

Following is an example of a fern-type perfume utilizing n-butyl-para-dioxane.

| | Percent By Weight |
|---|---|
| Amyl salicylate | 20 |
| Coumarin | 6 |
| Phenylethyl alcohol | 8 |
| Geraniol | 20 |
| Geranium Bourbon | 12 |
| Benzyl acetate | 14 |
| n-Butyl-para-dioxane | 10 |
| Benzyl salicylate | 10 |
| | 100 |

EXAMPLE 8

Following is an example of a chypre-type perfume utilizing n-butyl-para-dioxane.

| | Percent By Weight |
|---|---|
| Benzyl salicylate | 12 |
| Phenylethyl alcohol | 8 |
| Bergamot | 20 |
| Geranium Algerian | 10 |
| Tolu resin | 5 |
| Olibanum resin | 5 |
| Jasmin compound | 30 |
| n-Butyl dioxane | 10 |
| | 100 |

EXAMPLE 9

Following is an example of a Geranium-type perfume, utilizing n-hexyl-para-dioxane.

| | Percent By Weight |
|---|---|
| Geraniol | 30 |
| Citronellol | 30 |
| Citronellal | 10 |
| Phenylethyl alcohol | 10 |
| Geranyl formate | 10 |
| n-Hexyl-para-dioxane | 10 |
| | 100 |

EXAMPLE 10

Following is an example of a Lily-of-the-Valley type perfume utilizing n-dodecyl-para-dioxane.

| | Percent By Weight |
|---|---|
| Citronellol | 20 |
| Geraniol | 20 |
| Phenylethyl alcohol | 10 |
| Hydroxycitronellol | 30 |
| Phenylacetaldehyde | 2 |
| Terpineol | 13 |
| n-Dodecyl-para-dioxane | 5 |
| | 100 |

EXAMPLE 11

To 100 parts by weight of the perfume mixture illustrated in Example 7 are blended 10 parts by weight of n-octadecyl-para-dioxane to function as a fixative.

EXAMPLE 12

| | Percent By Weight |
|---|---|
| Silica, 90%–100% passes through a 325-mesh screen | 85.5 |
| Sodium dodecylbenzenesulfonate | 1.0 |
| Potassium dichloroisocyanurate | 2.0 |
| Hexyl-para-dioxane | 0.5 |
| Sodium carbonate | 9.0 |
| Water | 2.0 |
| | 100.0 |

Having thus described the invention, persons skilled in the art will be aware of modifications within the spirit thereof, and the invention is to be limited only within the scope of the appended claims.

What is claimed is:

1. A perfume blend comprising about 10% to about 90% by weight of phenylethyl alcohol, the balance being a compound of the formula

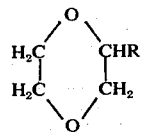

wherein R is a straight-chain hydrocarbon radical having from about 4 to about 22 carbon atoms, and mixtures thereof.

2. A perfume blend comprising about 10% to about 90% by weight of geranium oil, the balance being a compound of the formula

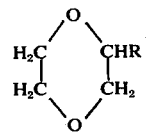

wherein R is a straight-chain hydrocarbon radical having from about 4 to about 22 carbon atoms.

3. A perfume mixture comprising about 75% to about 99% by weight of phenylethyl alcohol, the balance being a compound selected from the group consisting of n-octyl-para-dioxane, n-decyl-para-dioxane, and n-dodecyl-para-dioxane, and mixtures thereof.

4. A perfume mixture comprising about 50% to about 99% by weight of geranium oil, the balance being n-hexyl-para-dioxane.

5. A perfume mixture comprising about 75% to about 99% by weight of lavender oil, the balance being n-butyl-para-dioxane.

* * * * *